US005377843A

United States Patent [19]

Schumacher

[11] Patent Number: 5,377,843

[45] Date of Patent: Jan. 3, 1995

[54] CLASSIFYING WHEEL FOR CENTRIFUGAL-WHEEL AIR CLASSIFIER

[75] Inventor: Georg Schumacher, Gessertshausen, Germany

[73] Assignee: Hosokawa Alpine Aktiengesellschaft, Augsburg, Germany

[21] Appl. No.: 991,549

[22] Filed: Dec. 10, 1992

[30] Foreign Application Priority Data

Dec. 10, 1991 [DE] Germany ..... 4140656

[51] Int. Cl.[6] ..... B07B 7/08

[52] U.S. Cl. ..... 209/139.2; 209/142; 209/148

[58] Field of Search ..... 209/134, 138, 139.1, 209/139.2, 143, 144, 148, 150, 142

[56] References Cited

U.S. PATENT DOCUMENTS

| | | | |
|---|---|---|---|
| 2,269,412 | 1/1942 | Sturtevant | 209/144 |
| 2,542,095 | 2/1951 | Rouget | 209/148 X |
| 2,953,307 | 9/1960 | Lykken et al. | 209/144 X |
| 3,269,537 | 8/1966 | Kaiser | 209/144 |
| 3,384,238 | 5/1968 | Alpha | 209/144 X |
| 3,498,453 | 3/1970 | Kaiser et al. | 209/144 |
| 4,409,097 | 10/1983 | Barthelmess | 209/144 X |
| 4,528,091 | 7/1985 | Nied et al. | 209/139.1 |
| 4,786,406 | 11/1988 | Nied et al. | 209/139.1 |

FOREIGN PATENT DOCUMENTS

| | | | |
|---|---|---|---|
| 0392453 | 10/1990 | European Pat. Off. | 209/144 |
| 469805 | 12/1928 | Germany . | |
| 555228 | 6/1932 | Germany . | |
| 3131442 | 2/1983 | Germany . | |
| 3508889 | 3/1986 | Germany . | |
| 2061399 | 5/1991 | United Kingdom . | |
| WO90/06827 | 6/1990 | WIPO . | |

OTHER PUBLICATIONS

"The Oil Engine and Gas Turbine", Apr. 1957, pp. 472–473.

Patent Abstracts of Japan, vol. 14, No. 80 (C-689)(4023) Feb. 15, 1990 & JP-A-01 297 182 (Kurimoto Ltd.) Nov. 30, 1989.

*Primary Examiner*—D. Glenn Dayoan
*Assistant Examiner*—Tuan N. Nguyen
*Attorney, Agent, or Firm*—Pennie & Edmonds

[57] ABSTRACT

A classifying wheel for a centrifugal-wheel air classifier, through which the classifying air flows from outside to the inside against its centrifugal action. The wheel has blades arranged in a ring extending parallel to the axis of rotation of the wheel. The blades are positioned between a circular disc carrying the classifying wheel hub and an annular cover disc. The classifying wheel is entirely made in one piece and of a wear-resistant sintered material. The flow channels of the classifying wheel are formed by the surfaces of the classifying wheel blades extending parallel to each other and in direction of the axis of rotation of the wheel.

9 Claims, 1 Drawing Sheet

CLASSIFYING WHEEL FOR CENTRIFUGAL-WHEEL AIR CLASSIFIER

FIELD OF THE INVENTION

The invention refers to an air classifier equipped with a rotating classifying wheel through which the classifying air flows from outside to the inside against its centrifugal action, this wheel having blades arranged in a ring and extending parallel to the axis of rotation which are positioned between a circular disc carrying the classifying wheel hub and an annular cover disc. The invention refers to a classifying wheel for such an air classifier with blades made of a wear-resistant sintered material.

BACKGROUND OF THE INVENTION

A classifying wheel of the above-mentioned type has been known e.g. by U. S. Pat. No. 4,786,406. There, an air classifier is described whose classifying wheel comprises blades entirely made of a wear-resistant sintered material and inserted with axial clearance into recesses of a circular disc carrying the classifying wheel hub on the one hand and of an annular-like cover disc on the other hand. The blades are fixed in their mutual position and radially supported against the circular and the cover disc by inserts matching the recesses and made of a rubber-elastic, wear-resistant material. Materials of highest purity whose products are made useless even with the slightest contamination due to e.g. abrasion at product-contact surfaces can be processed free of wear and abrasion by means of this air classifier type. Even with highly abrasive materials of a Mohs' hardness of above 4, wear-free and thus profitable operation of the air classifier is possible.

This classifier, however, is adversely affected by the efforts required for dynamic balancing of the classifying wheel composed from various parts, as the classifying wheels are operated at maximum peripheral speeds of above 50 m/s. Furthermore, classifying wheels equipped with blades made of sintered material are not as rigid as those made of steel and thus can be operated only at approx. 80% of the maximum peripheral speed of the steel classifying wheels without modification of the sealing between classifying wheel and suction tube for the fines.

From GB 20 61 399 A it has been known that the single vanes of a pump impeller together with parts of the cover discs axially limiting the flow channels are shaped as one-piece vane element made of a refractory, wear-resistant material (mentioned are tungsten carbide or aluminium oxide) by metal-cutting processing before sintering. The single vane elements are put together after sintering to be the impeller, and this one is mounted between two shaped metal discs, resulting in a sandwich construction of the required strength. The sintered-material parts exclusively serve for wear protection against the conveyed fluid containing solids. In this process merely sliding friction takes place, in that the geometry of the vane channels, as with all flow machines is designed for utmost wall-parallel fluid flow.

With centrifugal-wheel air classifiers of the type considered, completely different flow conditions in the vane channels are to be observed. It is true, that corresponding to a pump or blower a blade wheel is there present as an essential operational component, but a blower outside the air classifier produces a flow in the blade channels of the classifying wheel contrary to the flow produced by operation of the classifying wheel as blower impeller, i.e., the flow through the classifying wheel passes from its external periphery radially to the inside, and thus against its centrifugal action. As a result, sharp flow deflection develops at the blade edges at the wheel periphery giving a centrifugal acceleration to the product particles conveyed by the classifying air as one factor that controls the classification process.

This then results from the combined effect of the centrifugal force of the particles and the sweeping force applied on the particles by the classifying air. With smaller particles, the sweeping force predominates, thus they are taken by the classifying air and discharged as fines.

With bigger particles and agglomerates of smaller particles, the centrifugal force predominates, thus these particles receive a movement at right angles to flow direction of the classifying air which deflects them outwards and causes impacting with the blades of the classifying wheel. Compact particles are therefore thrown outwards and discharged as coarse material. Agglomerates are disintegrated into the individual particles and re-classified. Contrary to pumps or blowers, the blades of the classifying wheel are mainly stressed by impacting forces and the resulting wear.

This type of stress can be completely controlled by means of the classifying wheel described by U.S. Pat. No. 4,786,406 disregarding the mentioned disadvantages.

SUMMARY OF THE INVENTION

These disadvantages are prevented by a classifying wheel manufactured according to the invention with the circular disc carrying the classifying wheel hub, the annular-like cover disc, and the blades arranged in between and parallel to the axis of rotation entirely made in one piece and of a wear-resistant sintered material.

The classifying wheel of this invention eliminates the disadvantages of the prior art. The classifying wheel can be manufactured with high measuring precision and thus does not require dynamic balancing for it is entirely made in one piece and of uniform, sintered material, so that bolting, gluing, soldering, or any other connection means are not necessary. Furthermore, a high dimensional stability is achieved which allows the sealing between fine and coarse material chamber of the classifier at the annular-like cover disc of the classifying wheel to be designed as simple ring gap. The smaller density of the material compared with steel with correspondingly lower mass forces and its strength make higher speeds possible as with a corresponding classifying wheel made of steel. The operating range of a classifying wheel can therefore be enlarged towards finer cut points. An additional advantage is the possibility of using hot gas for classification. The temperature, however, is limited by the thermal rating of the classifying wheel bearing.

The design of the flow channels in the classifying wheel with parallel walls leads not only to easy manufacture, but also to an unexpected and surprising fact of improved separation precision of the classifying process and better wear behavior in comparison to all known classifying wheels.

Figure 3:
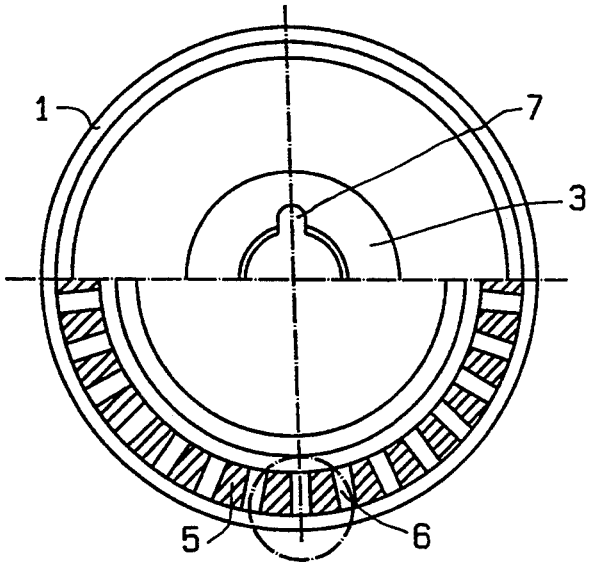
FIG. 3 is a composite top and bottom view of the classifying wheel.

FIG., 4 is an enlarged view of the encircled section of FIG. 3.

DETAILED DESCRIPTION OF THE PREFERRED EMBODIMENTS

For the manufacture of the classifying wheel body, the methods and installations of the sintering technique and the powder metallurgy are applied. As described in German patent specification No. 555 228, for example, the pulverized base material—ceramic or metallic sintering powders—is formed together with a binder into a sintered compact. This compact is machined to the desired shape and then is sintered. Finally, it is only necessary to finish the classifying wheel by fine machining of its hub bore to a size for an immediate seat on the drive shaft and of the outer front faces of its circular disc and cover disc to exact vertical alignment with respect to the axis of rotation. For pressing the compact, one can proceed according to the German patent specification No. 469 805, for example, which describes a method and processing tools that make possible to manufacture a compact having a complex structure as the classifying wheel body with a uniform density.

The classifying wheel 1, consisting of the circular disc 2 with hub 3, the cover disc 4 and the blades 5 forming the flow channels, is completely made in one piece and of sintered material. The bore in hub 3 shows a finished size enabling direct mounting of the classifying wheel 1 onto the drive shaft (not shown). For torque transmission an adequately shaped feather key is provided which engages with the groove 7 of hub 3, the cross-section of which is a semi-circle. The radially oriented and axial extending elongated flow channels 6 are formed by surfaces of the blades 5 which extend parallel to each other and in direction of the axis of rotation 8. Their axial ends form arc surfaces in the transition range adjacent the circular disc 2 and cover disc 4, respectively. The easiest way to achieve the shape of the flow channels 6 is by using a cylindrical end-milling cutter.

Figure 1:
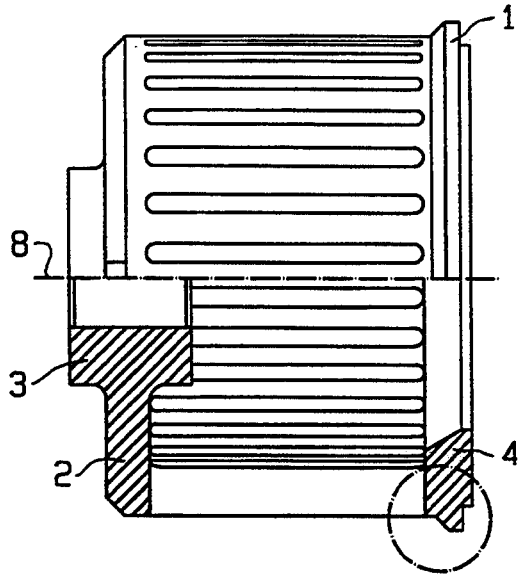
FIG. 1 is a side view of the classifying wheel, partly in cross-section.
Figure 2:
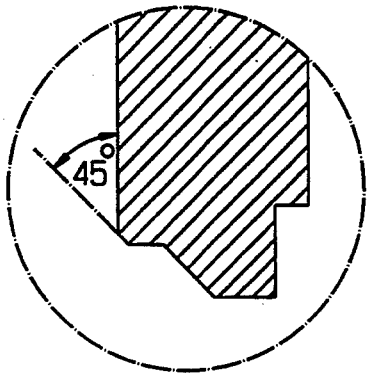
FIG. 2 is an enlarged view of the encircled section of FIG. 1.
Figure 4:
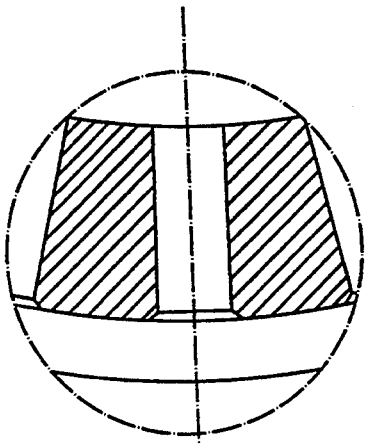

As shown in FIGS. 2 and 4, the blade edges are chamfered at the external perimeter of the classifying wheel. The flow channels 6 formed between the circumferentially spaced blades 5 are between 1/10 to 1/7 of the outer diameter of the classifying wheel.

The classifying wheel may range in diameter between 50 and 200 mm. For example, the wheels may have diameters of 50, 100 and 200 mm. With such diameters, the width of each flow channel is between 4 to 6 mm in circumferential direction. Also, the ratio of the thickness of each blade to the width of one flow channel at the periphery of the classifying wheel, in the circumferential direction, is between about 1.60 to 1 and 1.65 to 1.

I claim:

1. Classifying wheel for an air classifier equipped with a rotating classifying wheel through which the classifying air flows from outside to the inside against its centrifugal action, the wheel having blades which are arranged in a ring, extend parallel to the axis of rotation of the wheel and are positioned between a circular disc carrying the classifying wheel hub and an annular cover disc, the classifying wheel comprising:

a) a circular disc (2), hub (3), cover disc (4), and blades (5) positioned between the discs and extending parallel to the axis of rotation (8) of the wheel, b) said discs, hub and blades being entirely a one piece construction of a sintered material; and c) the blades (5) being spaced circumferentially of each other to define axially extending elongated flow channels (6) formed by surfaces of the blades (5) which extend parallel to each other and in direction of the axis of rotation (8), the axial ends of the flow channels (6) forming arc-like surfaces in the areas adjacent the circular disc (2) and the cover disc (4).

2. Classifying wheel according to claim 1, wherein: the hub (3) includes a bore having a finished size enabling direct mounting of the classifying wheel onto a drive shaft.

3. Classifying wheel according to claim 1, wherein: the edges of the blades (5) at the periphery of the classifying wheel are chamfered.

4. Classifying wheel according to claim 3, wherein: the hub (3) includes a groove (7) for engagement with an complimentary shaped feather key in said drive shaft for transmission of torque, said groove (7) being a semi-circle in cross-section.

5. Classifying wheel according to claim 4, wherein: the flow channels (6) are radially oriented.

6. Classifying wheel according to claim 5, wherein: the dimension in radial direction of each flow channel (6) is 1/10 to 1/7 of the outer diameter of the classifying wheel.

7. Classifying wheel according to claim 5, wherein: the width of each flow channel (6) is 4 to 6 mm in circumferential direction with wheels having an outside diameter ranging from about 50 to 200 mm.

8. Classifying wheel according to claim 7, wherein: the ratio of the thickness of one blade (5) to the width of one flow channel (6) at the periphery of the classifying wheel (1) in circumferential direction is between about 1.60 to 1 and 1.65 to 1.

9. Classifying wheel according to any one of claims 2–8 wherein:

the classifying wheel is a one piece construction of sintered ceramic.

* * * * *